US010398992B2

(12) United States Patent
Kerner et al.

(10) Patent No.: US 10,398,992 B2
(45) Date of Patent: Sep. 3, 2019

(54) TOY FIGURINE WITH LIGHT AND SOUND EFFECTS

(75) Inventors: William J. Kerner, Redondo Beach, CA (US); Mark J. Barthold, Santa Monica, CA (US); James W. Mazzolini, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 701 days.

(21) Appl. No.: 13/595,559

(22) Filed: Aug. 27, 2012

(65) Prior Publication Data

US 2013/0122778 A1 May 16, 2013

Related U.S. Application Data

(60) Provisional application No. 61/528,405, filed on Aug. 29, 2011.

(51) Int. Cl.
*A63H 3/00* (2006.01)
*A63H 33/22* (2006.01)
(Continued)

(52) U.S. Cl.
CPC ..... *A63H 3/00* (2013.01); *A63H 3/006* (2013.01); *A63H 3/20* (2013.01); *A63H 3/28* (2013.01); *A63H 3/36* (2013.01); *A63H 9/00* (2013.01); *A63H 33/22* (2013.01); *Y10T 29/49117* (2015.01)

(58) Field of Classification Search
CPC . A63H 3/006; A63H 3/20; A63H 3/28; A63H 3/46; A63H 13/00; A63H 13/06; A63H 2027/1058; A63H 13/005; A63H 13/02; A63H 13/04; A63H 13/045; A63H 13/08; A63H 13/10; A63H 13/12;
(Continued)

(56) References Cited

U.S. PATENT DOCUMENTS 3,425,153 A 2/1969 Bonanno et al.
3,755,960 A 9/1973 Tepper et al.
(Continued)

FOREIGN PATENT DOCUMENTS

CN 1197634 C 4/2005
CN 2834649 Y 11/2006
(Continued)

OTHER PUBLICATIONS

Office Action dated Oct. 27, 2014 in Chinese Patent Application No. 201210312812.0.
(Continued)

*Primary Examiner* — Melba Bumgarner
*Assistant Examiner* — Amir A Klayman
(74) *Attorney, Agent, or Firm* — Edell, Shapiro & Finnan, LLC

(57) ABSTRACT

A toy figurine includes internal light and sound effects that are coordinated with the manipulation of a toy figurine joint. The toy figurine joint may be configured to perform an action when manipulated. The light and sound effects may be coordinated with the performance of that action. The light and sound effects may serve to enhance or embellish the performance of that action. The embellishment stimulates the senses and the imagination and otherwise enhances the play value of the toy figure.

20 Claims, 14 Drawing Sheets

(51) Int. Cl.

| | |
|---|---|
| ***A63H 3/28*** | (2006.01) |
| ***A63H 3/36*** | (2006.01) |
| ***A63H 3/20*** | (2006.01) |
| ***A63H 9/00*** | (2006.01) |

(58) Field of Classification Search
CPC ..... A63H 13/14; A63H 13/15; A63H 13/16; A63H 13/18; A63H 13/20
See application file for complete search history.

(56) References Cited

U.S. PATENT DOCUMENTS

| | | | | |
|---|---|---|---|---|
| 3,762,720 | A * | 10/1973 | Jett | A63B 69/3635 473/202 |
| 4,349,987 | A * | 9/1982 | Bart | A63H 13/00 446/355 |
| 4,536,166 | A | 8/1985 | Renger et al. | |
| 4,579,543 | A | 4/1986 | Renger et al. | |
| 4,601,669 | A | 7/1986 | Hsieh | |
| 4,721,489 | A | 1/1988 | Galoob | |
| 4,738,649 | A | 4/1988 | Delli Bovi et al. | |
| 4,842,564 | A | 6/1989 | Gerold et al. | |
| 4,988,323 | A | 1/1991 | Price | |
| 5,011,449 | A | 4/1991 | Handy et al. | |
| 5,087,219 | A | 2/1992 | Price | |
| 5,211,282 | A | 5/1993 | Ting | |
| 5,267,886 | A | 12/1993 | Wood et al. | |
| 5,334,069 | A | 8/1994 | Liu | |
| 6,053,797 | A | 4/2000 | Tsang et al. | |
| 6,062,941 | A | 5/2000 | Cook | |
| 6,224,455 | B1 | 5/2001 | Laurienzo | |
| 6,262,355 | B1 * | 7/2001 | Koch | G10H 1/34 84/600 |
| 6,280,045 | B1 * | 8/2001 | Anteby et al. | 362/103 |
| 6,296,543 | B1 * | 10/2001 | Andrews | A63F 7/0668 446/297 |
| 6,368,178 | B1 | 4/2002 | Berman | |
| 6,461,217 | B1 | 10/2002 | Pestonji | |
| 7,448,987 | B2 * | 11/2008 | Arginsky et al. | 482/77 |
| 7,537,506 | B2 | 5/2009 | de la Torre | |
| 2005/0159072 | A1 | 7/2005 | Brown et al. | |
| 2006/0292965 | A1 | 12/2006 | Strauss | |
| 2007/0149089 | A1 * | 6/2007 | De La Torre | A63H 3/20 446/373 |
| 2008/0070472 | A1 | 3/2008 | Campbell | |
| 2009/0221210 | A1 * | 9/2009 | Lin | A63H 13/00 446/81 |

FOREIGN PATENT DOCUMENTS

| | | | |
|---|---|---|---|
| CN | 101198386 | A | 6/2008 |
| CN | 101489635 | A | 7/2009 |
| CN | 101511439 | A | 8/2009 |
| WO | 0009229 | A1 | 2/2000 |

OTHER PUBLICATIONS

Combined Search and Examination Report for British Patent Application No. GB1215203.9, dated Nov. 2, 2012, 7 pages.

* cited by examiner

TOY FIGURINE WITH LIGHT AND SOUND EFFECTS

CROSS-REFERENCE TO RELATED APPLICATION

This application claims priority to and is based on U.S. Patent Application No. 61/528,405, filed Aug. 29, 2011, entitled "Toy Figurine with Light and Sound Effects," the entire disclosure of which is incorporated by reference herein in its entirety.

FIELD OF THE INVENTION

The disclosure relates generally to a toy figure. More specifically, the toy figurine includes internal light and sound effects that are coordinated with the manipulation of a toy figurine joint.

BACKGROUND

Toy figures have been and continue to be a stable source of amusement for children. Enhancements that spark a child's imagination and features that provide continued engagement of the toy figurine with the child add to its play value and build a bond between the child and the toy figure.

U.S. Pat. No. 6,296,543 B1 to Andrews discloses a toy figurine having an enhanced punching feature. When the toy figure's torso is pivoted and released, the upper torso rapidly pivots back to its original alignment imparting a punching motion to one of the toy figure's arms. The punching arm supports a switch, a flash element, and a light emitting diode (LED). A control circuit responds to actuation of the switch to produce a crash-type sound and to energize the flash element to provide a simultaneous burst of bright light each time the toy figure's hand impacts a suitable object. While Andrews provides an entertaining play pattern, the activation of light and sound is limited to when the figure's hand impacts an object.

The WWE FLEXFORCE product line by MATTEL includes action figures that re-enact the signature moves of certain WWE personalities. For example, the FIST POUNDIN' JOHN CENA action figurine includes a torso joint at the stomach area of the figure. A child may pivot the upper torso backwards by pulling the figure's arms up and back. Releasing the figure's arms causes both the arms and the torso joint to quickly return to their original positions. Through this sequence of motions, the child may re-enact their wrestling idol picking up and hurling an opponent into ringside ropes or smashing down on an opponent with two beefy fists. Similarly, the HOOK THROWIN' CHRIS JERICHO action figurine includes elbow and shoulder joints that quickly return to their original positions to simulate a hook punch. The BIG TALKIN' TRIPLE H action figurine includes a similar elbow and shoulder joint, but further includes a "signature phrase," such as "time to play the game," that the figurine "speaks" when the arm is pulled back about the shoulder joint. Additionally, the FLIP KICKIN' REY MYSTERIO action figurine includes knee, hip and ankle joints that quickly return to their original positions to allow the figurine to simulate a kick or perform a flip. The ROUND HOUSE KICKIN' EVAN BOURNE action figurine includes a leg joint that quickly returns to its original position to allow the figurine to simulate a kick. The leg joint in this figurine is described with more detail in U.S. patent application Ser. No. 13/495,584, filed on Jun. 13, 2012, entitled Toy Figure with Articulating Limb, which is hereby incorporated by reference in full. These WWE FLEXFORCE action figures do not include any electronics, including flashing lights or "charging up" sounds to accompany their movements.

The GREEN LANTERN GALACTIC SCALE KILOWOG action figurine by MATTEL includes an internally lit-up ring symbol on the figure's chest. When the figure's right arm is raised from down by its side to straight up in front, the light-up ring symbol flashes with a steady pulse. The light pulses continue for a set time regardless of whether the arm stays up or is moved back to its original lowered position while the light pulses. The figurine does not include any sound to accompany its movement, nor do the figure's light pulses indicate any "charging up" patterns.

SUMMARY

The toy figurine includes internal light and sound effects that are coordinated with the manipulation of a toy figurine joint. The toy figurine joint may be configured to perform an action when manipulated and the light and sound effects may be coordinated with the performance of that action. The light and sound effects may serve to enhance or embellish the performance of that action.

Other systems, methods, features and advantages will be, or will become, apparent to one with skill in the art upon examination of the following figures and detailed description. All such additional systems, methods, features and advantages are included within this description, are within the scope of the claimed subject matter, and are protected by the following claims.

BRIEF DESCRIPTION OF THE DRAWINGS

The toy figurine with internal light and sound effects may be better understood with reference to the following drawings and description. The elements in the figures are not necessarily to scale, emphasis instead being placed upon illustrating the principles of the toy figurine with internal light and sound effects. In the figures, like-referenced numerals designate corresponding parts throughout the different views.

DETAILED DESCRIPTION

The toy figurine includes internal light and sound effects that are coordinated with the manipulation of a toy figurine joint. The toy figurine joint may be configured to perform an action when manipulated. For example, an arm joint may be biased to return to a position in front of the figure, such that when the figure's arm is pulled back and released, the resulting motion simulates the figurine throwing a punch. The light and sound effects may be coordinated with the performance of that action. The light and sound effects may serve to enhance or embellish the performance of that action. For example, the light and sound effects may provide the appearance of the figure's arm charging up energy before throwing the simulated punch.

Figure 1:
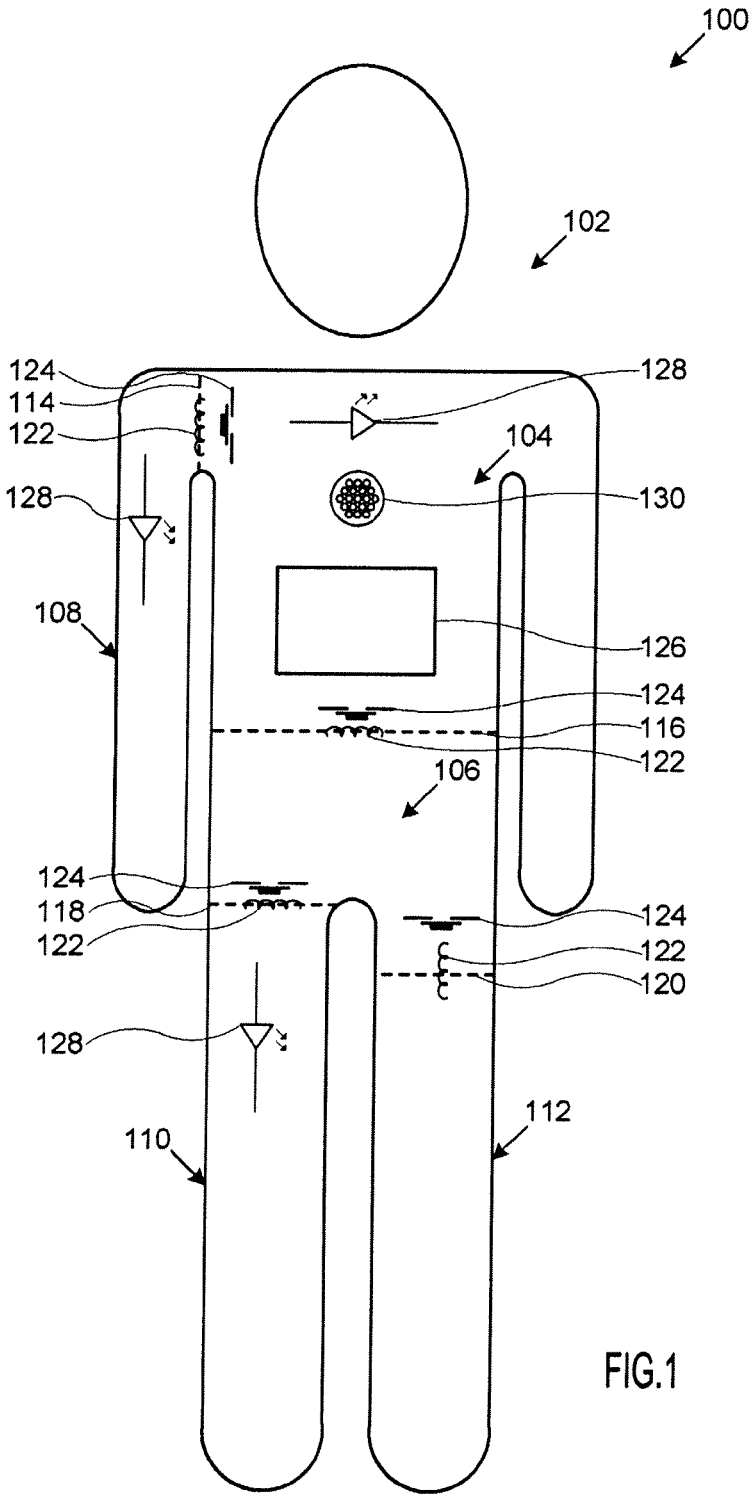
FIG. 1 is a diagram of a toy figure.

FIG. 1 is a diagram 100 of a toy figurine 102 according to some embodiments of the present invention. The toy figurine 102 includes a torso, which includes an upper torso 104 and a lower torso 106, and various members, including two arms, one of which is an action arm 108, and two legs, an action leg 110 and a stabilizing leg 112. The action arm 108 connects to the upper torso 104 at a shoulder joint 114. The shoulder joint 114 includes an elastic member 122 that connects the action arm 108 to the upper torso 104. The elastic member 122 may bias the action arm 108 and the upper torso 104 into a first configuration. For example, the elastic member 122 may be a torsion spring that biases the arm into a position extending straight out in front of the torso of the figure. Thus, if the arm is pulled back about the shoulder joint 114, such that the arm and torso are in a second configuration, and then released, the arm will snap back to extending in front of the torso. A switch 124 is positioned proximate the shoulder joint 114. The switch 124 closes when the arm and torso are in the second configuration. The switch 124 signals a controller 126, and the controller 126 controls an illumination circuit 128 in the arm and a sound circuit 130 in the torso. The controller 126 may coordinate the activation of the illumination circuit 128 and the sound circuit 130 to enhance the experience of manipulating the arm into the second configuration and/or releasing the arm from the second configuration.

In one example that simulates a "charging up" of the arm, the illumination circuit 128 may pulse light at a first frequency when the arm and the torso are first manipulated into the second configuration. The light may pulse at a second frequency that is higher than the first frequency after the arm and torso are held in the second configuration for a first predetermined amount of time. After the arm and torso continue to be held in the second configuration for a second predetermined amount of time, which may be greater than the first predetermined amount of time, the light may cease pulsing and instead remain constantly lit. This sequence of light pulses may represent that the arm is "charged up." Alternatively, the light may begin pulsing slowly with a gradual increase in the pulsing frequency until the pulsing reaches a constant lighting.

Continuing the example, the sound circuit 130 may produce a first sound after the arm and torso are held in the second configuration for the second predetermined amount of time. The first sound may represent that the arm is "charged up." Alternatively or additionally, the sound circuit 130 may produce a preliminary sound after the first predetermined amount of time. The preliminary sound may build up with the first sound to further enhance the impression of an action "charging up."

When the arm and torso are released from the second configuration, the bias from the elastic member 122 may forcibly return the arm and torso toward the first configuration. The release may also open the switch 124. Opening the switch may signal the controller 126, and the controller 126 may then control the illumination circuit 128 in the arm and the sound circuit 130 in the torso to further enhance the release of the arm from the second configuration.

In one example that simulates "decharging" of the arm, the light may begin the sequence in a constantly lit state while the arm and torso are in the second configuration. Upon release of the arm from the second configuration, the light may first blink and then begin a slow fade to dark. The fade to darkness may represent the arm "decharging." Alternatively, the light may provide a quick flash before suddenly going dark. Continuing the example, the sound circuit 130 may produce a second sound after the arm and torso are released from the second configuration. The second sound may represent that the arm is "decharging." In some embodiments, the sound may represent contact from a thrown punch. In other embodiments, the sound may represent a grunt of exertion from a person throwing a punch. An exemplary timeline for producing light and sound effects coordinated with the manipulation of a toy figurine is reproduced in FIG. 22.

Still referring to FIG. 1, the upper torso 104 connects to the lower torso 106 at a waist joint 116. In a manner similar to the action arm 108 and the upper torso 104 above, the waist joint 116 has an elastic member 122 that biases the upper torso 104 and the lower torso 106 into a first configuration. For example, the elastic member 122 may be a torsion spring that biases the upper torso 104 into a position extending straight up from the lower torso 106 of the figure. Thus, if the upper torso 104 is pulled back about the waist joint 116, such that the upper torso 104 and lower torso 106 are in a second configuration, and then released, the upper torso 104 will snap back toward extending straight up from the lower torso 106. A switch 124 is positioned proximate the waist joint 116. The switch 124 closes when the upper torso 104 and lower torso 106 are in the second configuration. The switch 124 signals a controller 126, and the controller 126 controls an illumination circuit 128 and a sound circuit 130 in the upper torso 104. The controller 126 may coordinate the activation of the illumination circuit and the sound circuit 130 to enhance the manipulation of the upper torso 104 into the second configuration and/or the release of the upper torso 104 from the second configuration.

The action leg 110 connects to the lower torso 106 at a hip joint 118. In a manner similar to the action arm 108 and the upper torso 104 above, the hip joint 118 has an elastic member 122 that biases the action leg 110 and the lower torso 106 into a first configuration. For example, the elastic member 122 may be a torsion spring that biases the action leg 110 into a position extending straight down from the lower torso 106 of the figure. Thus, if the action leg 110 is pulled back about the hip joint 118, such that the action leg 110 and lower torso 106 are in a second configuration, and then released, the action leg 110 will snap back toward extending straight down from the lower torso 106. A switch 124 is positioned proximate the hip joint 118. The switch 124 closes when the action leg 110 and lower torso 106 are in the second configuration. The switch 124 signals a controller 126, and the controller 126 controls an illumination circuit 128 in the action leg 110 and a sound circuit 130 in the torso. The controller 126 may coordinate the activation of the illumination circuit and the sound circuit 130 to enhance the manipulation of the action leg 110 into the second configuration and/or the release of the action leg 110 from the second configuration.

The stabilizing leg 112 connects to the lower torso 106 at a leg joint 120. In a manner similar to the action arm 108 and the upper torso 104 above, the leg joint 120 has an elastic member 122 that biases the stabilizing leg 112 and the lower torso 106 into a first configuration. For example, the elastic member 122 may be a torsion spring that biases the stabilizing leg 112 into a position extending straight down from the lower torso 106 of the figure. Thus, if the lower torso 106 is twisted about the leg joint 120, such that the stabilizing leg 112 and lower torso 106 are in a second configuration, and then released, the lower torso 106 will snap back such that the stabilizing leg 112 extends straight down from the lower torso 106. A switch 124 is positioned proximate the leg joint 120. The switch 124 closes when the stabilizing leg 112 and lower torso 106 are in the second configuration. The switch 124 signals a controller 126, and the controller 126 controls an illumination circuit 128 in the action leg 110 and a sound circuit 130 in the torso. The controller 126 may coordinate the activation of the illumination circuit and the sound circuit 130 to enhance the manipulation of the lower torso 106 into the second configuration and/or the release of the lower torso 106 from the second configuration.

Figure 2:
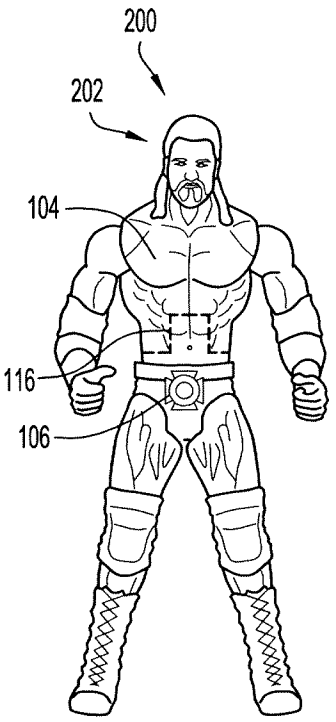
FIG. 2 is a depiction of a toy figurine with an illumination circuit in its upper torso.

FIG. 2 is a depiction 200 of a toy figurine 202 with an illumination circuit in its upper torso according to some embodiments of the present invention. The toy figurine 202 includes an upper torso 104 connected to a lower torso 106 at a waist joint 116. The waist joint 116 includes an elastic member that biases the upper torso 104 and the lower torso 106 into a first configuration, as illustrated here. The upper torso 104 may be pulled back about the waist joint 116, such that the upper torso 104 and lower torso 106 are in a second configuration, and then released. Upon release, the upper torso 104 will snap back toward extending straight up from the lower torso 106. Manipulating the upper torso 104 and the lower torso 106 into the second configuration may trigger light or sound effects from the toy figurine 202, including a light effect in the upper torso 104.

Figure 3:
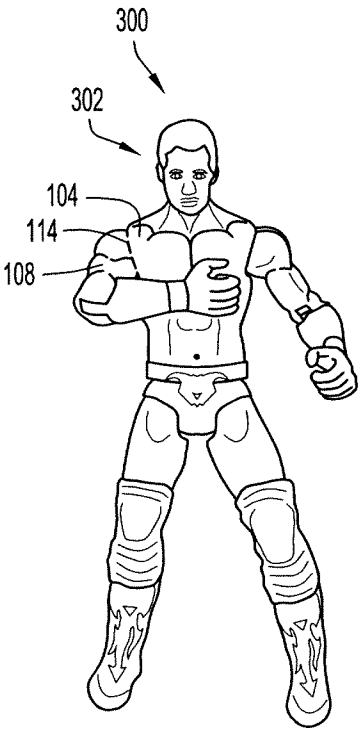
FIG. 3 is a depiction of a toy figurine with an illumination circuit in its arm.

FIG. 3 is a depiction 300 of a toy figurine 302 with an illumination circuit in its arm according to some embodiments of the present invention. The toy figurine 302 includes an action arm 108 connected to an upper torso 104 at a shoulder joint 114. The shoulder joint 114 includes an elastic member that biases the action arm 108 and the upper torso 104 into a first configuration, as illustrated here. The action arm 108 may be pulled back about the upper torso 104, such that the action arm 108 and upper torso 104 are in a second configuration, and then released. Upon release, the action arm 108 will snap back toward extending straight out in front of the upper torso 104. Manipulating the action arm 108 and the upper torso 104 into the second configuration may trigger light or sound effects from the toy figurine 302, including a light effect in the action arm 108.

Figure 4:
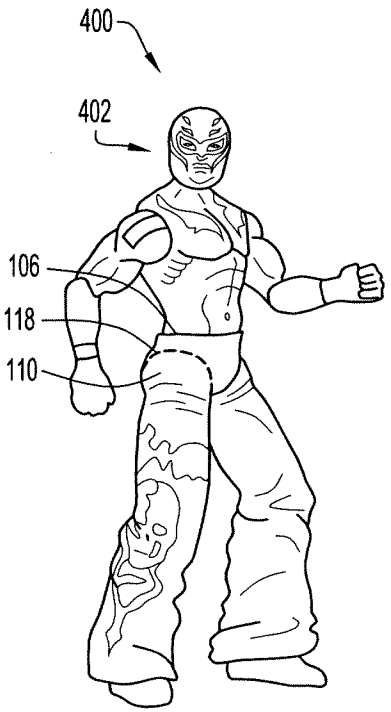
FIG. 4 is a depiction of a toy figurine with an illumination circuit in its leg.

FIG. 4 is a depiction 400 of a toy figurine 402 with an illumination circuit in its leg according to some embodiments of the present invention. The toy figurine 402 includes an action leg 110 connected to a lower torso 106 at a hip joint 118. The hip joint 118 includes an elastic member that biases the action leg 110 and the lower torso 106 into a first configuration, as illustrated here. The action leg 110 may be pulled back about the lower torso 106, such that the action leg 110 and lower torso 106 are in a second configuration, and then released. Upon release, the action leg 110 will snap back toward extending straight down from the lower torso 106. Manipulating the action leg 110 and the lower torso 106 into the second configuration may trigger light or sound effects from the toy figurine 402, including a light effect in the action leg 110.

Figure 5:
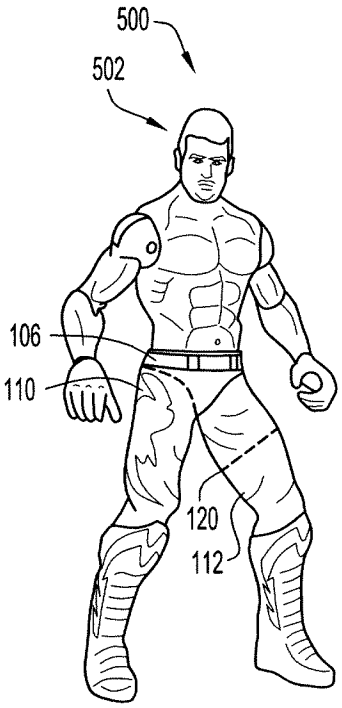
FIG. 5 is a depiction of a second toy figurine with an illumination circuit in its leg.

FIG. 5 is a depiction 500 of a second toy figurine 502 with an illumination circuit in its leg according to some embodiments of the present invention. The toy figurine 502 includes a stabilizing leg 112 connected to a lower torso 106 at a leg joint 120. The leg joint 120 includes an elastic member that biases the stabilizing leg 112 and the lower torso 106 into a first configuration, as illustrated here. The lower torso 106 may be twisted about the leg joint 120, such that the stabilizing leg 112 and lower torso 106 are in a second configuration, and then released. Upon release, the lower torso 106 will snap back such that the stabilizing leg 112 extends straight down from the lower torso 106. Manipulating the stabilizing leg 112 and the lower torso 106 into the second configuration may trigger light or sound effects from the toy figurine 502, including a light effect in an action leg 110.

Figure 6:
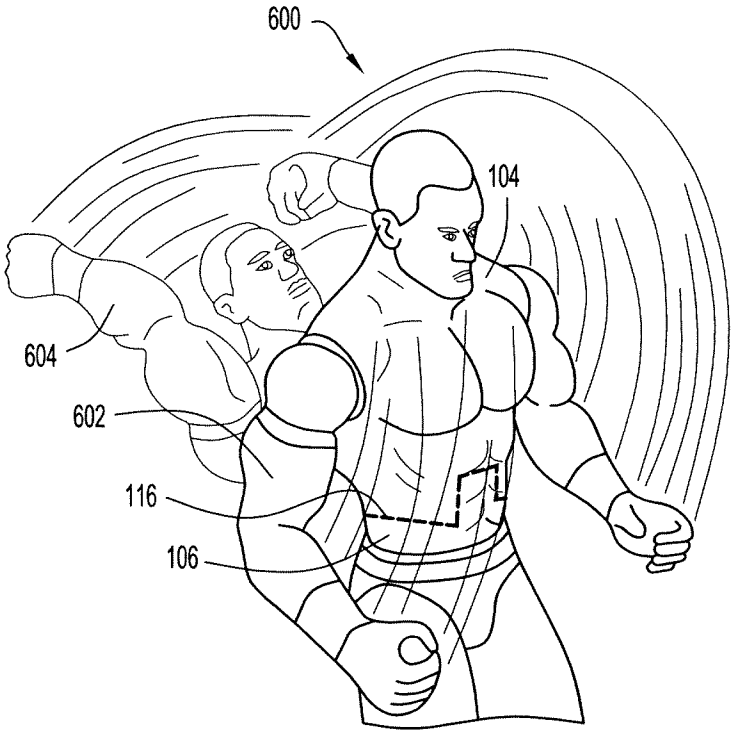
FIG. 6 is a depiction of a toy figurine posed in different configurations.

FIG. 6 is a depiction 600 of a toy figurine posed in different configurations according to some embodiments of the present invention. The depicted toy figurine includes an upper torso 104 connected to a lower torso 106 at a waist joint 116, similar to the toy figurine 202 depicted in FIG. 2. From a first configuration 602, the upper torso 104 may be pulled back about the waist joint 116, such that the upper torso 104 and lower torso 106 are in a second configuration 604, and then released. Upon release, the upper torso 104 will snap back toward the first configuration 602, i.e. extending straight up from the lower torso 106.

Figure 7:
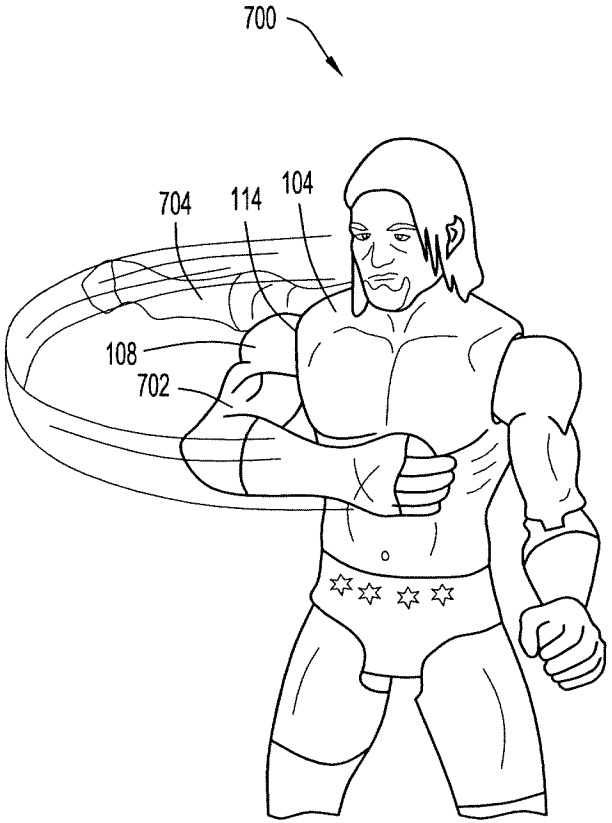
FIG. 7 is a depiction of an alternative toy figurine posed in different configurations.

FIG. 7 is a depiction 700 of an alternative toy figurine posed in different configurations according to some embodiments of the present invention. The depicted toy figurine includes an action arm 108 connected to an upper torso 104 at a shoulder joint 114, similar to the toy figurine 302 depicted in FIG. 3. From a first configuration 702, the action arm 108 may be pulled back about the upper torso 104, such that the action arm 108 and upper torso 104 are in a second configuration 704, and then released. Upon release, the action arm 108 will snap back toward the first configuration 702, i.e. extending straight out in front of the upper torso 104

Figure 8:
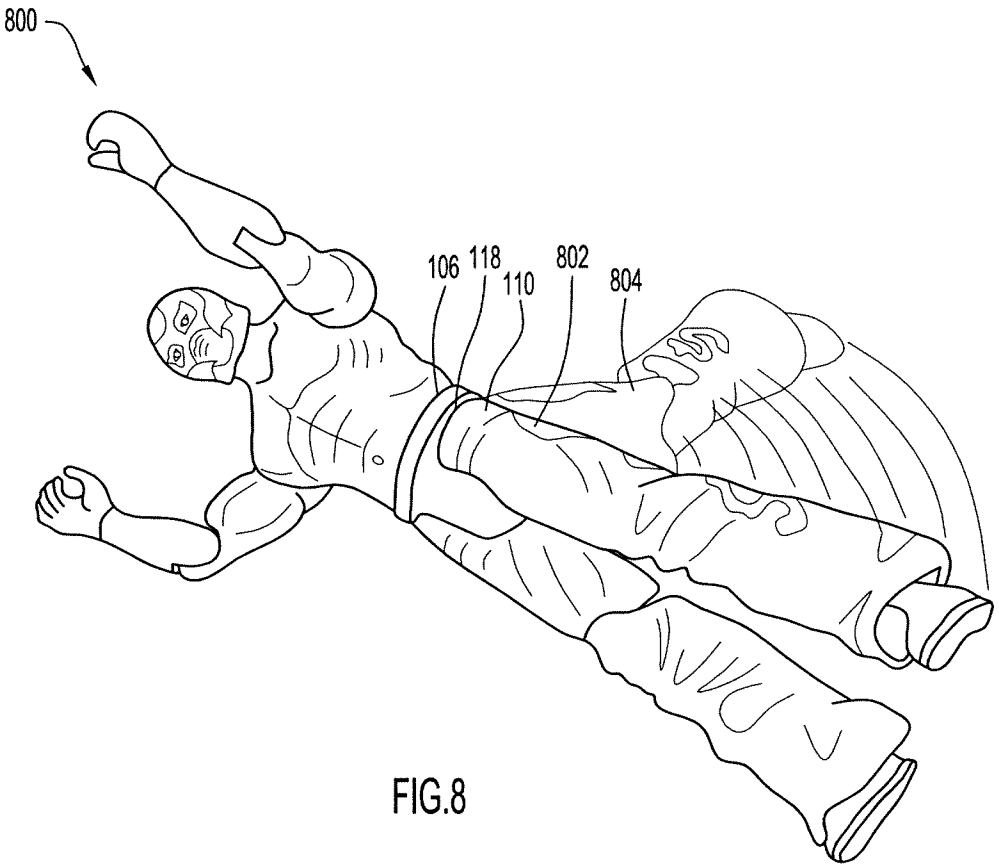
FIG. 8 is a depiction of a second alternative toy figurine posed in different configurations.

FIG. 8 is a depiction 800 of a second alternative toy figurine posed in different configurations according to some embodiments of the present invention. The depicted toy figurine includes an action leg 110 connected to a lower torso 106 at a hip joint 118, similar to the toy figurine 402 depicted in FIG. 4. From a first configuration 802, the action leg 110 may be pulled back about the lower torso 106, such that the action leg 110 and lower torso 106 are in a second configuration 804, and then released. Upon release, the action leg 110 will snap back toward the first configuration 802, i.e. extending straight down from the lower torso 106. Manipulation of the toy figures in the depictions 600, 700 and 800 into or out of the different configurations may trigger light and/or sound effects.

Figure 9:
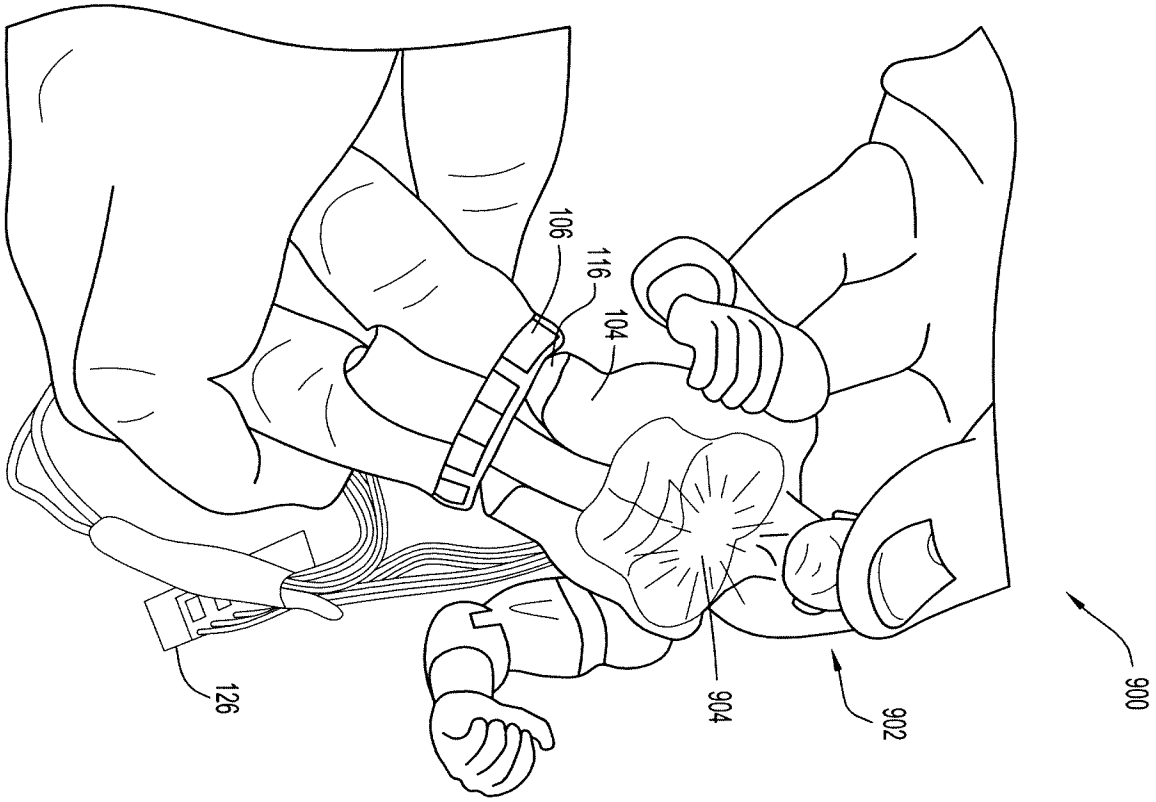
FIG. 9 is a depiction of an alternative toy figurine with an illumination circuit in its upper torso.

FIG. 9 is a depiction 900 of an alternative toy figurine 902 with an illumination circuit in its upper torso according to some embodiments of the present invention. The toy figurine 902 includes an upper torso 104 connected to a lower torso 106 at a waist joint 116, similar to the toy figurine 202 depicted in FIG. 2. The upper torso 104 is pulled back about the waist joint 116, such that the upper torso 104 and lower torso 106 are in a second configuration. A switch positioned proximate the waist joint 116 has triggered a light effect 904 in the upper torso 104. The light effect 904 may originate from a light source, such as a light emitting diode (LED), embedded within the upper torso 104 and controlled by a controller 126.

Figure 10:
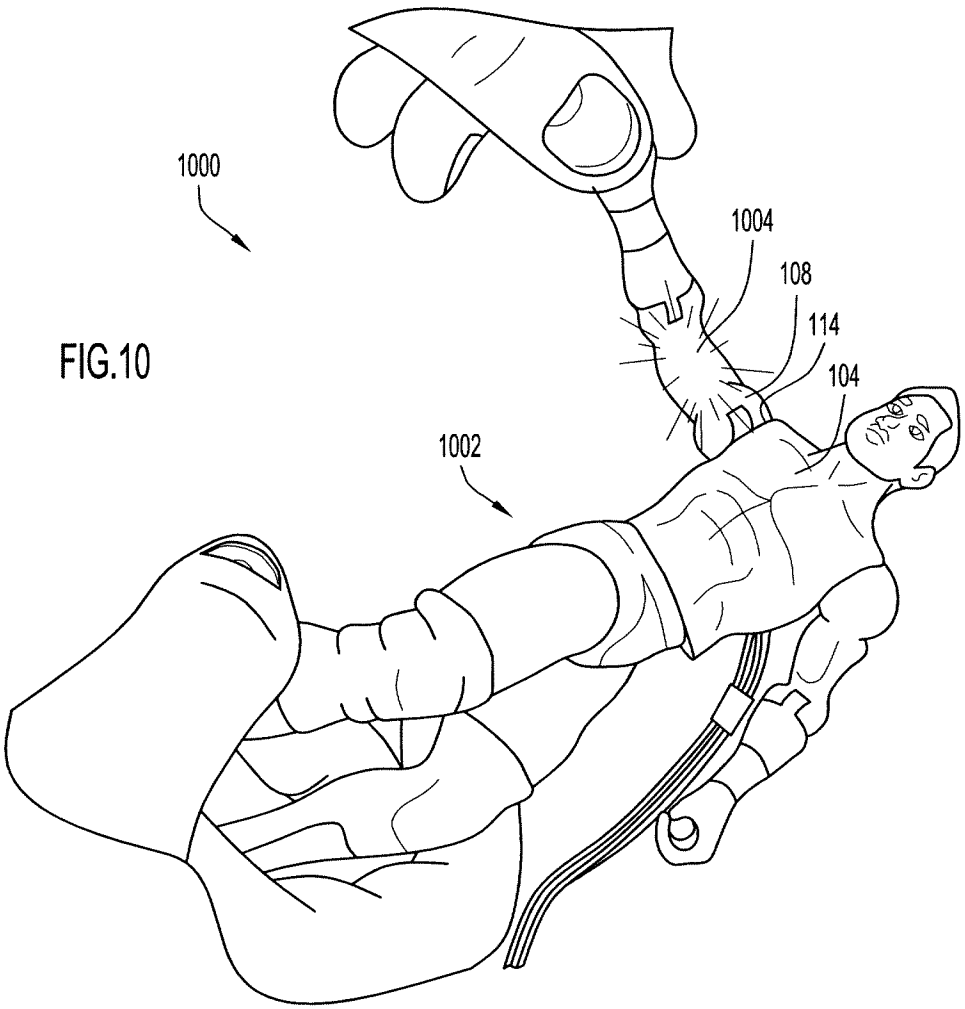
FIG. 10 is a depiction of an alternative toy figurine with an illumination circuit in its arm.

FIG. 10 is a depiction 1000 of an alternative toy figurine 1002 with an illumination circuit in its arm according to some embodiments of the present invention. The toy figurine 1002 includes an action arm 108 connected to an upper torso 104 at a shoulder joint 114, similar to the toy figurine 302 depicted in FIG. 3. The action arm 108 is pulled back about the upper torso 104, such that the action arm 108 and upper torso 104 are in a second configuration. A switch positioned proximate the shoulder joint 114 has triggered a light effect 1004 in the action arm 108. The light effect 1004 may originate from a LED embedded within the action arm 108 and controlled by a controller.

Figure 11:
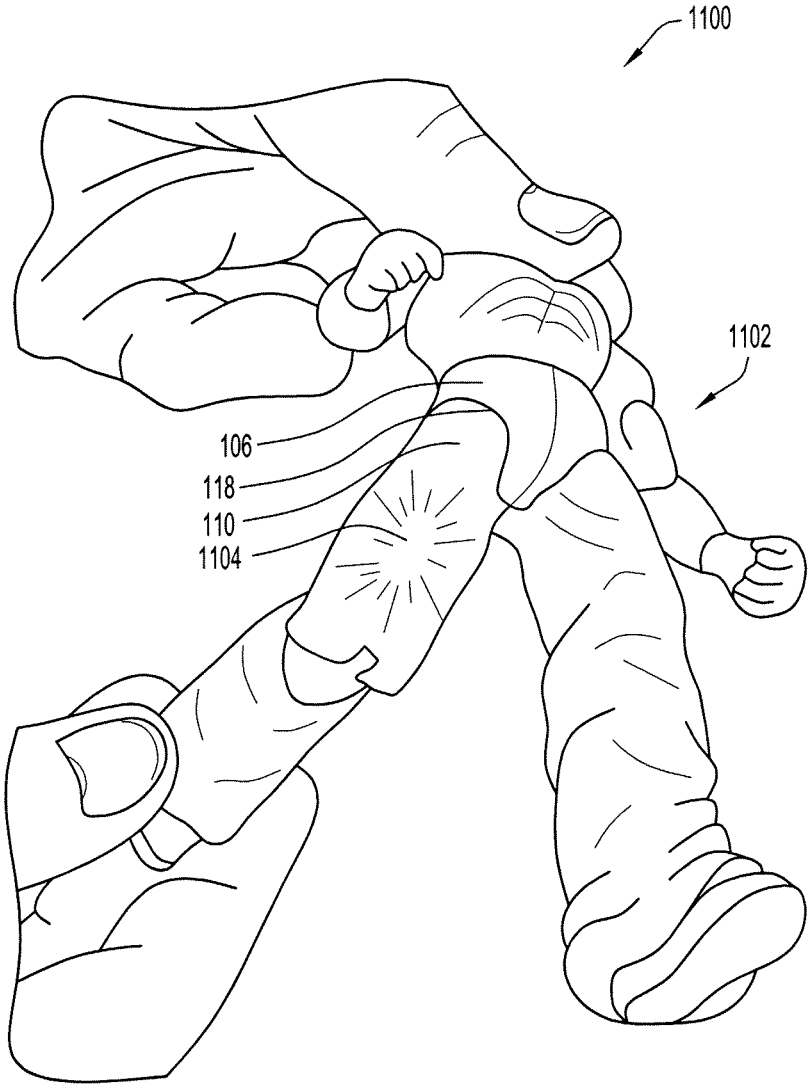
FIG. 11 is a depiction of an alternative toy figurine with an illumination circuit in its leg.

FIG. 11 is a depiction 1100 of an alternative toy figurine 1102 with an illumination circuit in its leg according to some embodiments of the present invention. The toy figurine 1102 includes an action leg 110 connected to a lower torso 106 at a hip joint 118, similar to the toy figurine 402 depicted in FIG. 4. The action leg 110 is pulled back about the lower torso 106, such that the action leg 110 and lower torso 106 are in a second configuration. A switch positioned proximate the hip joint 118 has triggered a light effect 1104 in the action leg 110. The light effect 1104 may originate from a LED embedded within the action leg 110 and controlled by a controller.

Figure 12:
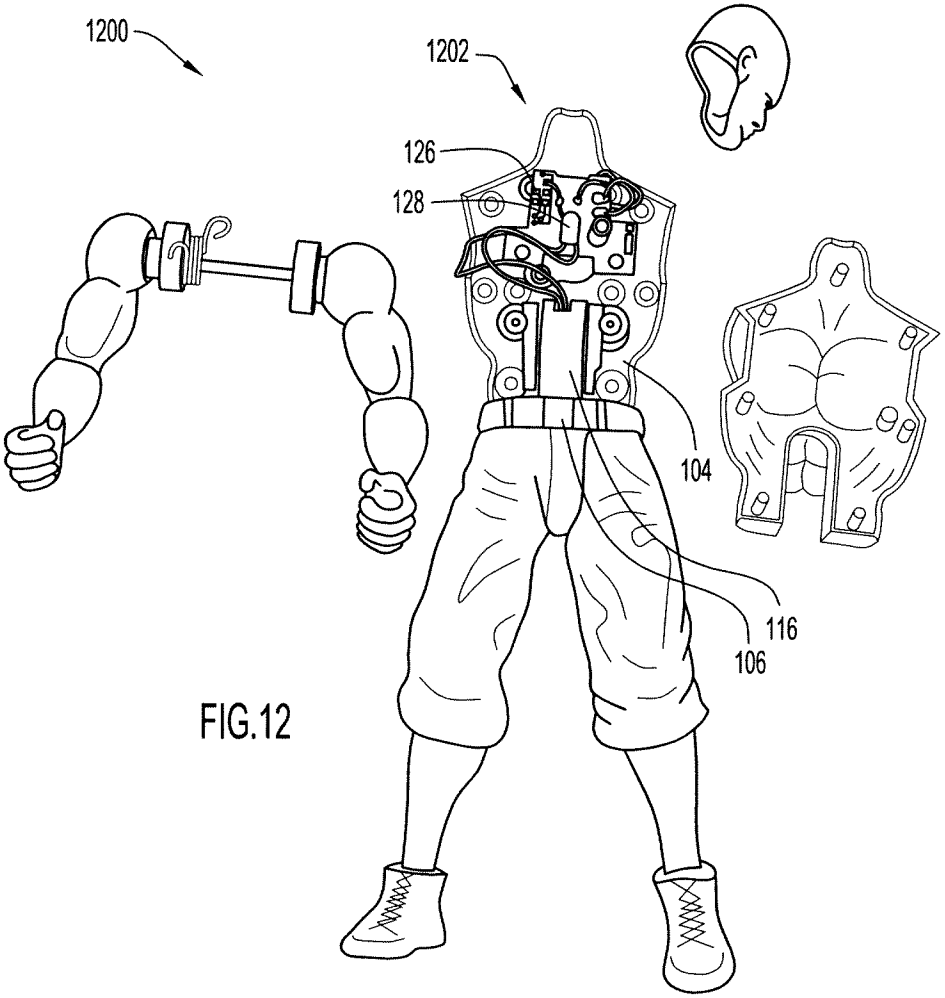
FIG. 12 is a depiction of an internal compartment of a toy figurine with an illumination circuit in its upper torso.

FIG. 12 is a depiction 1200 of an internal compartment of a toy figurine 1202 with an illumination circuit in its upper torso according to some embodiments of the present invention. The toy figurine 1202 includes an upper torso 104 connected to a lower torso 106 at a waist joint 116, similar to the toy figurine 202 depicted in FIG. 2. A switch positioned proximate the waist joint 116 may be in electrical or communicative contact with a controller 126. The controller 126 is also in electrical or communicative contact with an illumination circuit 128 in the upper torso 104 and a sound circuit in the torso.

Figure 13:
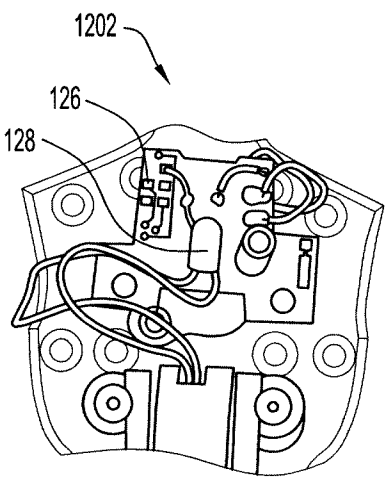
FIG. 13 is a zoomed-in view of the internal compartment of a toy figurine with an illumination circuit in its upper torso.

FIG. 13 is a zoomed-in view of the internal compartment of a toy figurine 1202 with an illumination circuit in its upper torso. In this embodiment, the controller 126 and the illumination circuit 128 share the same printed circuit board.

Figure 14:
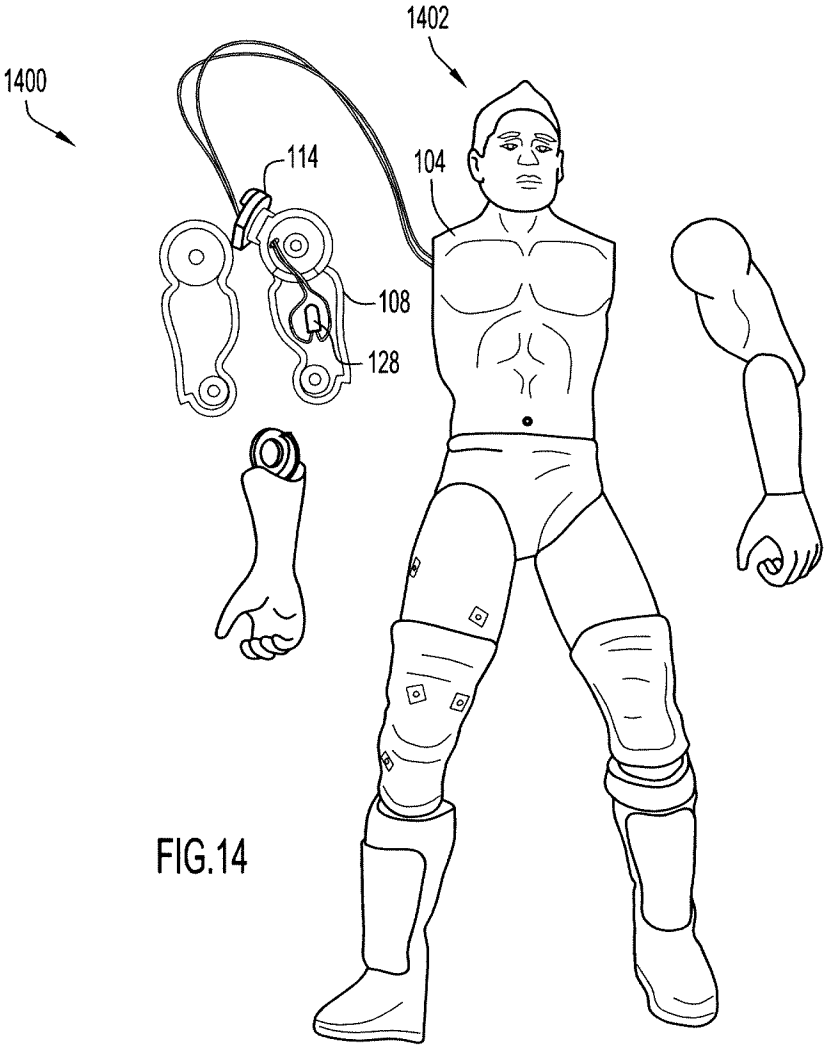
FIG. 14 is a depiction of an internal compartment of a toy figurine with an illumination circuit in its arm.

FIG. 14 is a depiction 1400 of an internal compartment of a toy figurine 1402 with an illumination circuit in its arm according to some embodiments of the present invention. The toy figurine 1402 includes an action arm 108 that connects to an upper torso 104 at a shoulder joint 114, similar to the toy figurine 302 depicted in FIG. 3. A switch positioned proximate the shoulder joint 114 may be in electrical or communicative contact with a controller. The controller is also in electrical or communicative contact with an illumination circuit 128 in the action arm 108 and a sound circuit in the torso.

Figure 15:
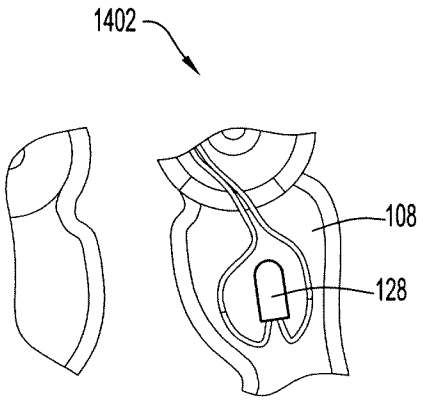
FIG. 15 is a zoomed-in view of the internal compartment of a toy figurine with an illumination circuit in its arm.

FIG. 15 is a zoomed-in view of the internal compartment of a toy figurine 1402 with an illumination circuit 128 mounted, embedded, or otherwise included in action arm 108. In this embodiment, the controller and the illumination circuit 128 are in separate locations within the figure.

Figure 16:
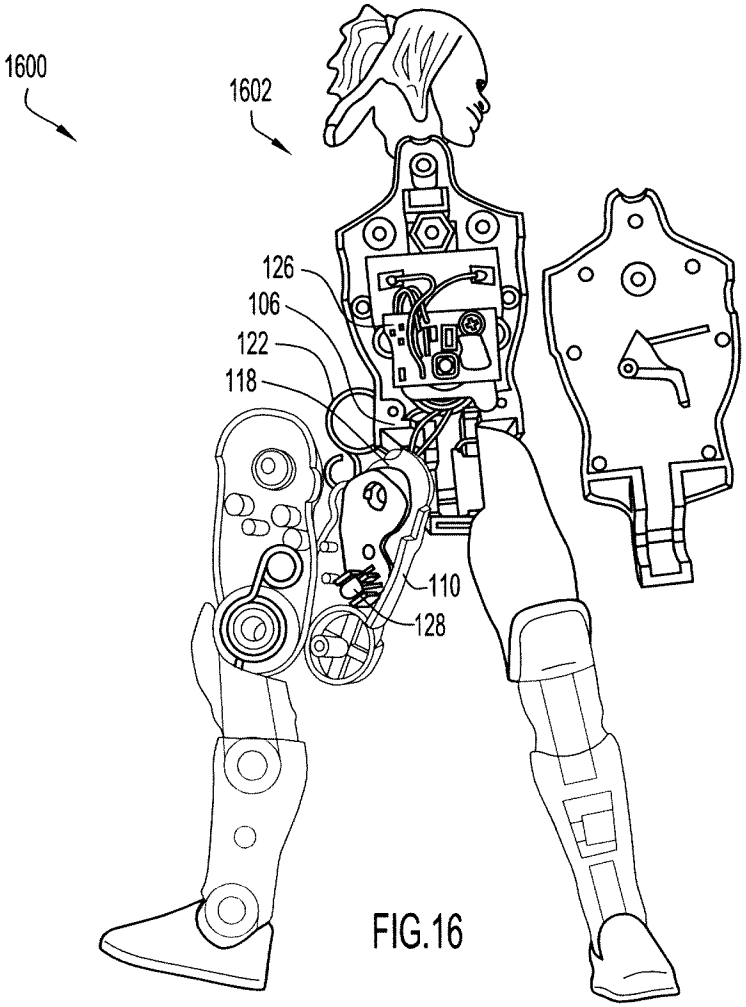
FIG. 16 is a depiction of an internal compartment of a toy figurine with an illumination circuit in its leg.

FIG. 16 is a depiction 1600 of an internal compartment of a toy figurine 1602 with an illumination circuit in its leg according to some embodiments of the present invention. The toy figurine 1602 includes an action leg 110 that connects to a lower torso 106 at a hip joint 118, similar to the toy figurine 402 depicted in FIG. 4. The hip joint 118 includes an elastic member 122 that connects the action leg 110 to the lower torso 106. In this embodiment, the elastic member 122 is a torsion spring that biases the action leg 110 into a position extending straight down from the lower torso 106. A switch positioned proximate the hip joint 118 may be in electrical or communicative contact with a controller 126. The controller 126 is also in electrical or communicative contact with an illumination circuit 128 in the action leg 110 and a sound circuit in the torso.

Figure 17:
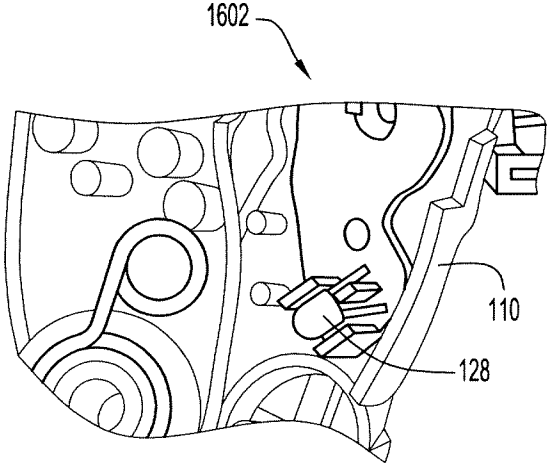
FIG. 17 is a zoomed-in view of the internal compartment of the toy figurine with an illumination circuit in its leg of FIG. 16.

FIG. 17 is a zoomed-in view of the internal compartment of a toy figurine 1602 with an illumination circuit 128 mounted, embedded, or otherwise included in action leg 110. In this embodiment, the controller 126 and the illumination circuit 128 are in separate locations within the figure.

Figure 18:
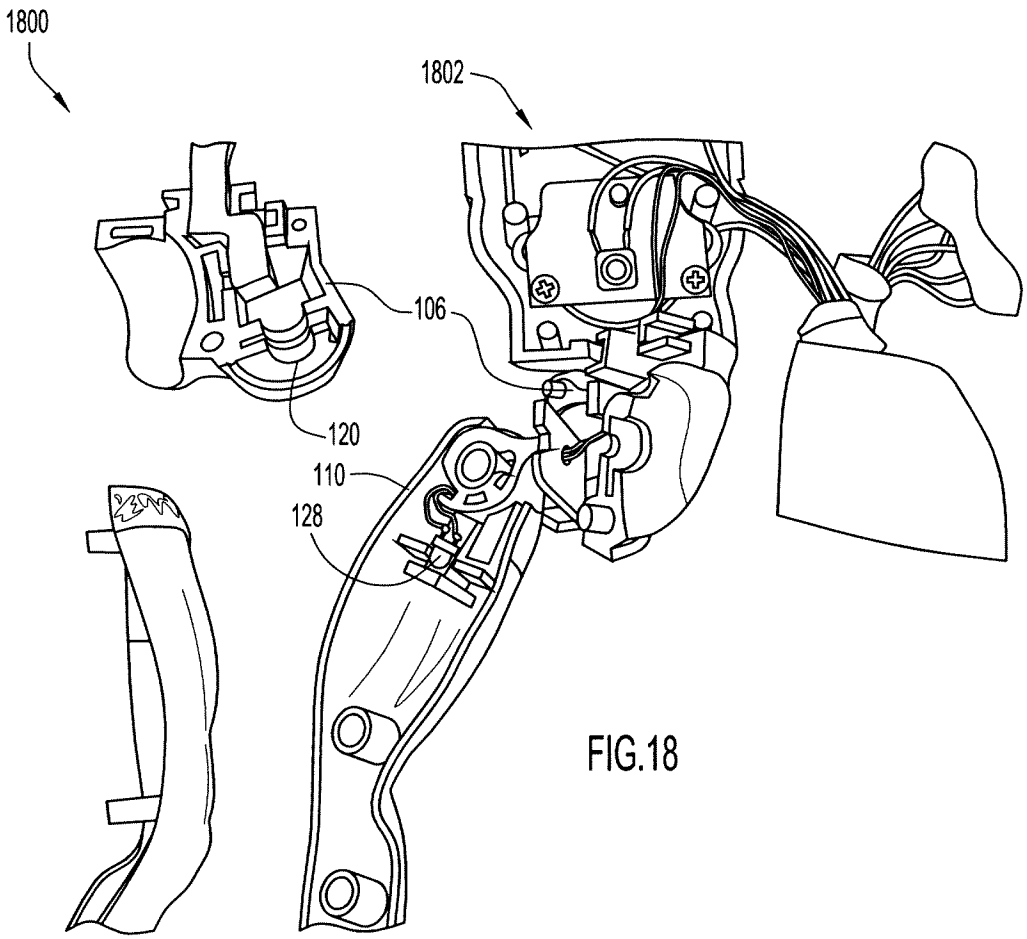
FIG. 18 is a depiction of an internal compartment of an alternative toy figurine with an illumination circuit in its leg.

FIG. 18 is a depiction 1800 of an internal compartment of an alternative toy figurine 1802 with an illumination circuit in its leg according to some embodiments of the present invention. The toy figurine 1802 includes a stabilizing leg (not shown in FIG. 18) that connects to a lower torso 106 at a leg joint 120, similar to the toy figurine 502 depicted in FIG. 5. A switch positioned proximate the leg joint 120 may be in electrical or communicative contact with a controller. The controller is also in electrical or communicative contact with an illumination circuit 128 in the action leg 110 and a sound circuit in the torso.

Figure 19:
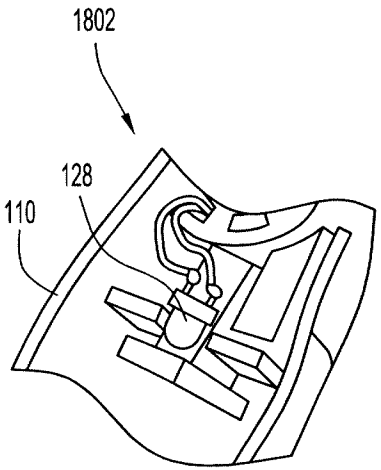
FIG. 19 is a zoomed-in view of the internal compartment of the alternative toy figurine with an illumination circuit in its leg of FIG. 18.

FIG. 19 is a zoomed-in view of the internal compartment of the alternative toy figurine 1802 with an illumination circuit 128 mounted, embedded, or otherwise included in its action leg 110. In this embodiment, the controller and the illumination circuit 128 are in separate locations within the figure.

Figure 20:
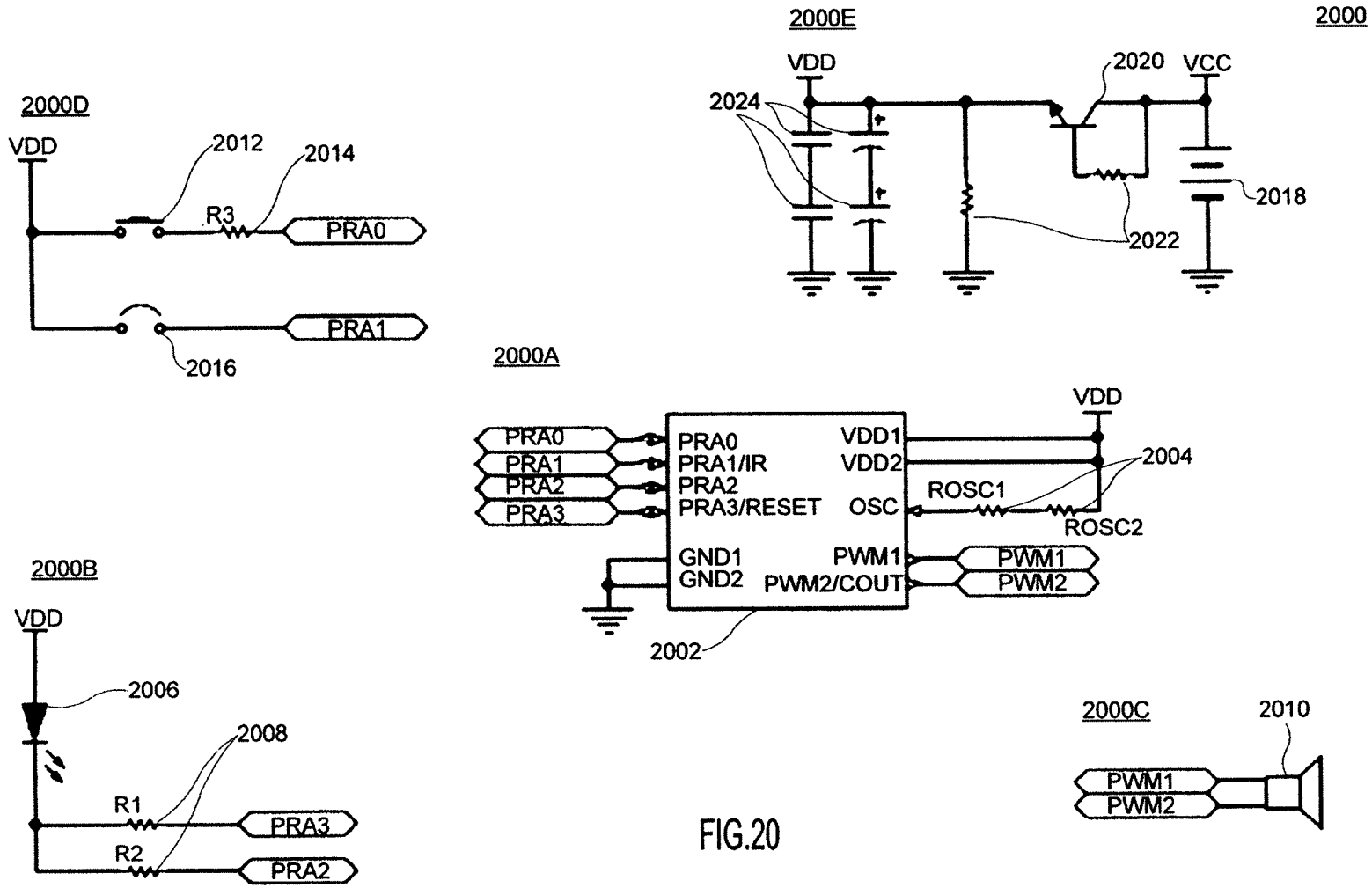
FIG. 20 is a circuit diagram for a toy figurine with light and sound effects.

FIG. 20 is a circuit diagram 2000 for a toy figurine with light and sound effects. The circuit diagram 2000 includes a controller circuit diagram 2000A, an illumination circuit diagram 2000B, a sound circuit diagram 2000C, a switch circuit diagram 2000D, and a power circuit diagram 2000E. The controller circuit diagram 2000A includes an integrated circuit 2002 and resistors 2004. The integrated circuit may include logic that controls the lights and sounds output by the toy figure. In this exemplary embodiment, the integrated circuit 2002 is a AM4EB010X one-channel speech and dual tone microcontroller unit from ALPHA MICROELECTRONICS CORP. Pins 1 (PWM2/COUT) and 3 (PWM1) are tied to leads from the sound circuit. Pin 6 (OSC) is tied by the two resistors 2004 in series (ROSC1, ROSC2) to the IC power supply VDD. Pins 2 (VDD1) and 5 (VDD2) are tied directly to the IC power supply VDD. Pins 7 (PRA0) and 8 (PRA1/IR) are tied to the switch circuit. Pins 9 (PRA2) and 11 (PRA3/RESET) are tied to the illumination circuit. Pins 4 (GND1) and 10 (GND2) are tied to ground.

The illumination circuit diagram 2000B includes a light source 2006 and two resistors 2008. One lead of the light source 2006 is connected to the IC power supply VDD, while the other lead is connected by the two resistors in parallel to PRA2 and PRA3 pins of the controller. The light source 2006 may be a LED, specifically a M3R4UCB66-S 3 mm Ultra Bright Red LED from STRONG BASE INVESTMENTS LTD. The sound circuit diagram 2000C includes a speaker 2010. The speaker 2010 is connected to the PWM1 and PWM2 pins of the controller. The speaker 2010 may be a HB-TY15055SC16R1-C1 15 mm 16 ohm 0.1 W H-5.5 mm Fe frame speaker from CAN PRODUCTS CO. LTD.

The switch circuit 2000D includes a switch 2012, a resistor 2014, and a test switch 2016. The switch 2012 and the resistor 2014 connect the IC power supply VDD to a PRA0 pin on the controller. The switch 2012 may be a push switch or a tact switch, such as a TD-123XAJ-160gf push switch from ZHAO DA ELECTRONIC LTD. Test switch 2016 also connects the IC power supply VDD to the controller, but via a PRA1 pin on the controller. The power circuit 2000E includes a power source 2018, a transistor 2020, two resistors 2022, and four capacitors 2024. The power source 2018 may be a LR44x3 microcell battery. The transistor 2020 may be an S8050 transistor.

Figure 21:
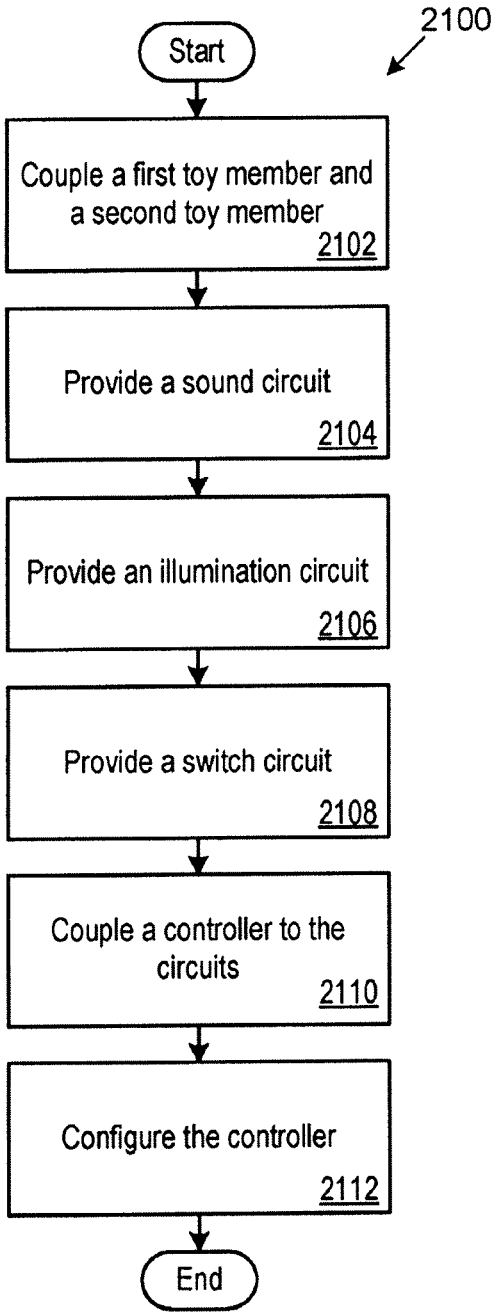
FIG. 21 is a flowchart for providing a toy figurine with light and sound effects.

FIG. 21 is a flowchart 2100 for providing a toy figurine with light and sound effects. A first toy member is coupled to a second toy member (2102). The two toy members may be coupled at a joint. The coupling may include an elastic member, such as a torsion spring. A sound circuit is provided (2104). The sound circuit may be provided within the torso of the toy figure. An illumination circuit is provided (2106). The illumination circuit may be provided in the first toy member, the second toy member, or a separate member of the toy figure, such as a torso or alternative appendage. Preferably, the illumination circuit is provided in an area of the toy figurine that provides a conceptual meaning of "charging up" the area. A switch circuit is provided (2108). The switch circuit may be provided proximate to where the first toy member and the second toy member are coupled. The switch circuit may be positioned such that it closes when the first toy member and the second toy member are in a particular configuration with respect to each other. A controller is coupled to the sound circuit, the illumination circuit, and the switch circuit (2110). The controller may be electrically or communicatively coupled to each of the circuits such that the controller and send and/or receive data from each of the circuits or otherwise control each circuit. The controller is configured (2112).

Figure 22:
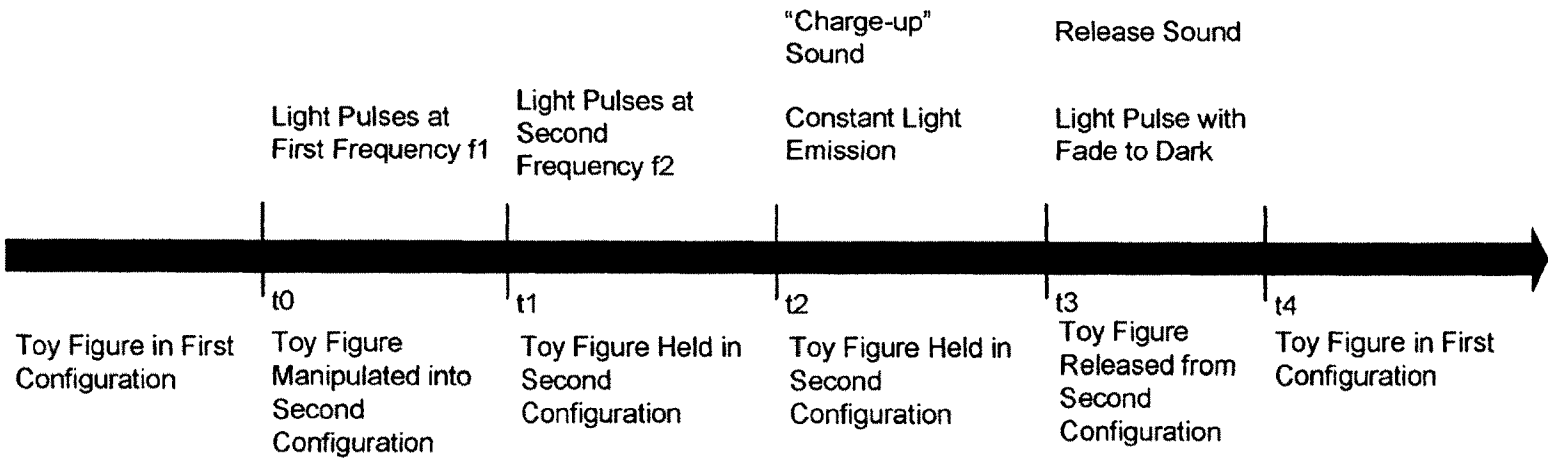
FIG. 22 is a timeline for activating light and sound effects in a toy figure.

Now referring to FIG. 22, a timeline for activating light and sound effects in a toy figurine may be depicted. The timeline illustrates exemplary configurations of the controller according to at least one embodiment of the present invention. For example, the controller may be configured to receive a signal from the switch when the first toy member and the second toy member are in a particular configuration. The controller may be further configured to cause the illumination circuit to pulse light at a first frequency when the first toy member and the second toy member are positioned in the particular configuration. The controller may be further configured to cause the illumination circuit to pulse light at a second frequency, higher than the first frequency, when the first toy member and the second toy member remain in the second configuration for a first predetermined time. The controller may be further configured to cause the illumination circuit to produce light at a constant rate after the first toy member and the second toy member remain in the particular configuration for a second predetermined amount of time greater than the first predetermined time. The controller may be further configured to cause the illumination circuit to produce a light effect when the first toy member and the second toy member are released from the second configuration. Release from the second configuration may occur when the switch opens. The controller may be further configured to cause the sound circuit to produce an audible sound when the first toy member and the second toy member are positioned in the particular configuration. The controller may be further configured to cause the sound circuit to produce the audible sound when the first toy member and the second toy member remain in the particular configuration for the first predetermined time. The controller may be further configured to cause the sound circuit to produce the audible sound after the first toy member and the second toy member remain in the predetermined configuration for a second predetermined amount of time greater than the first predetermined time. The controller may be configured to cause the sound circuit to produce a second audible sound after the first toy member and the second toy member are released from the second configuration.

It is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such disclosure should be understood to include incorporation of one or more such elements, neither requiring nor excluding two or more such elements.

While various embodiments of the toy figurine with internal light and sound effects have been described, it will be apparent to those of ordinary skill in the art that many more embodiments and implementations are possible within the scope of the invention. Thus, it is intended that the present invention covers modifications and variations of this invention provided they come within the scope of the appended claims and their equivalents.

What is claimed is:

1. A toy figurine comprising:

a figurine body with a first portion and a second portion, the first portion of the toy figurine and the second portion of the toy figurine being coupled together to form a figurine joint by an elastic member that biases the first portion and the second portion toward a first configuration, the first portion being selected from a first section of an upper torso of the figurine body, an arm of the figurine body, and a leg of the figurine body, the second portion being selected from a first section of an upper torso and a lower torso of the figurine body, and the figurine joint being selected from a waist joint, a shoulder joint, a hip joint, and a leg joint;

a power circuit including a power source;

a sound circuit for producing an audible sound;

an illumination circuit for producing light;

a switch circuit including a switch supported within the toy figurine and configured to be activated when the first portion and the second portion are positioned in a second configuration, wherein the second configuration is different from the first configuration; and a controller coupled to the power circuit, the sound circuit, the illumination circuit, and the switch circuit in a manner that allows the controller to:

in response to a first signal received from the switch circuit, cause the illumination circuit to pulse light at one or more frequencies when the switch is activated; and in response to a second signal received from the switch circuit upon release of the switch, cause the illumination circuit to produce a light effect, wherein the switch is released when the first portion and the second portion are released from the second configuration.

2. The toy figurine of claim 1, wherein the controller is further operable to cause the sound circuit to:

produce the audible sound when the first portion and the second portion are positioned in the second configuration.

3. The toy figurine of claim 1, wherein the controller is further operable to cause the illumination circuit to:

pulse light at a first frequency when the first portion and the second portion are positioned in the second configuration; and pulse light at a second frequency, higher than the first frequency, when the first portion and the second portion remain in the second configuration for a first predetermined amount of time.

4. The toy figurine of claim 3, wherein the controller is further operable to cause the sound circuit to:

produce the audible sound when the first portion and the second portion remain in the second configuration for the first predetermined amount of time.

5. The toy figurine of claim 3, wherein the controller is further operable to cause the illumination circuit to:

produce light at a constant rate after the first portion and the second portion remain in the second configuration for a second predetermined amount of time, wherein the second predetermined amount of time is greater than the first predetermined amount of time.

6. The toy figurine of claim 3, wherein the controller is further operable to cause the sound circuit to:

produce the audible sound after the first portion and the second portion remain in the second configuration for a second predetermined amount of time, wherein the second predetermined amount of time is greater than the first predetermined amount of time.

7. The toy figurine of claim 1, wherein the controller is further operable to cause the sound circuit to:

produce a second audible sound upon release of the switch.

8. A method of providing a toy figurine comprising:

coupling a first portion of a figurine body to a second portion of a figurine body with an elastic member to form a figurine joint that biases the first portion and the second portion toward a first configuration, the first portion being selected from a first section of an upper torso of the figurine body, an arm of the figurine body, and a leg of the figurine body, the second portion being selected from a second section of the upper torso and a lower torso of the figurine body, and the figurine joint being selected from a waist joint, a shoulder joint, a hip joint, and a leg joint;

providing a power circuit including a power source;

providing a sound circuit for producing an audible sound;

providing an illumination circuit for producing light within the toy figure;

providing a switch circuit including a switch supported within the toy figurine and configured to move to an activated position as the first portion and the second portion are manipulated into a second configuration different from the first configuration;

connecting a controller to the power circuit, the sound circuit, the illumination circuit, and the switch circuit in a manner that allows the sound circuit and illumination circuit to be selectively activated in response to at least one signal generated by the switch circuit; and configuring the controller to:

in response to a first signal received from the switch circuit, cause the illumination circuit to pulse light at one or more frequencies when the switch is in the activated position; and in response to a second signal received from the switch circuit upon release of the switch from the activated position, cause the illumination circuit to produce a light effect.

9. The method claim 8, further comprising:

configuring the controller to cause the sound circuit to produce the audible sound when the switch is in the activated position.

10. The method of claim 8, further comprising:

configuring the controller to cause the sound circuit to produce the audible sound upon release of the switch from the activated position.

11. The method of claim 8, wherein configuring the controller to cause the illumination circuit to pulse light at one or more frequency when the switch is in the activated position further comprises:

configuring the controller to cause the illumination circuit to pulse light at a first frequency when the switch is in the activated position; and configuring the controller to cause the illumination circuit to pulse light at a second frequency, higher than the first frequency, when the switch is in the activated position for a first predetermined amount of time.

12. The method of claim 11, further comprising:

configuring the controller to cause the illumination circuit to produce light at a constant rate after the switch remains in the activated position for a second predetermined amount of time, wherein the second predetermined amount of time is greater than the first predetermined amount of time.

13. The method claim 11, further comprising:

configuring the controller to cause the sound circuit to produce the audible sound when the switch remains in the activated position for the first predetermined amount of time.

14. The method of claim 11, further comprising:

configuring the controller to cause the sound circuit to produce the audible sound after the switch remains in the activated position for a second predetermined amount of time, wherein the second predetermined amount of time is greater than the first predetermined amount of time.

15. A toy figurine comprising:

a figurine body including a first portion and a second portion coupled together in a manner that forms a figurine joint biases the first portion and the second portion towards a first configuration, the first portion being selected from a first section of an upper torso of the figurine body, an arm of the figurine body, and a leg of the figurine body, the second portion being selected from a second section of the upper torso and a lower torso of the figurine body, and the figurine joint being selected from a waist joint, a shoulder joint, a hip joint, and a leg joint;

a power circuit including a power source;

a switch circuit including a switch that is closed when the first portion and the second portion are moved into a second configuration different from the first configuration; and a controller operably coupled to the switch circuit and the power circuit and configured to:

selectively operate a sound circuit for producing an audible sound based on at least one first signal received from the switch circuit when the switch is closed; and selectively operate an illumination circuit for producing light based on at least one second signal received from the switch circuit when the switch is open, wherein the controller is configured to operate the sound circuit and the illumination circuit so that the sound circuit produces the audible sound upon opening of the switch.

16. The toy figurine of claim 15, wherein the controller is further operable to:

cause the illumination circuit to pulse light at a first frequency when the switch is closed; and cause the illumination circuit to pulse light at a second frequency, higher than the first frequency, when the switch is closed for a first predetermined amount of time.

17. The toy figurine of claim 15, further comprising:

an elastic member, wherein the first portion and the second portion are coupled together by the elastic member that biases the first portion and the second portion towards the first configuration.

18. The toy figurine of claim 16, wherein the controller is further operable to:

cause the illumination circuit to produce light at a constant rate after the switch is closed for a second predetermined amount of time, wherein the second predetermined amount of time is greater than the first predetermined amount of time.

19. The toy figurine of claim 1, wherein the switch circuit is operable to:

send the first signal to the controller when the switch is activated; and send the second signal to the controller when the switch is released.

20. The method of claim 8, wherein the switch circuit is operable to:

send the first signal to the controller when the switch is in the activated position; and send the second signal to the controller when the switch is released from the activated position.

* * * * *